US006247771B1

(12) United States Patent
Miller

(10) Patent No.: US 6,247,771 B1
(45) Date of Patent: Jun. 19, 2001

(54) LOWER RACK LIFTING DEVICE FOR A DISHWASHER

(76) Inventor: Evelyn J. Miller, P.O. Box 65, Beallsville, PA (US) 15313

( * ) Notice: Subject to any disclaimer, the term of this patent is extended or adjusted under 35 U.S.C. 154(b) by 0 days.

(21) Appl. No.: 09/641,846

(22) Filed: Aug. 18, 2000

(51) Int. Cl.[7] ..... A47B 88/00
(52) U.S. Cl. ..... 312/310; 312/312; 312/272
(58) Field of Search ..... 312/310, 311, 312/312, 228, 228.1, 272, 319.5, 323, 351; 211/41.8, 41.9

(56) References Cited

U.S. PATENT DOCUMENTS

| | | | | |
|---|---|---|---|---|
| D. 247,416 | | 3/1978 | Berman et al. . | |
| 2,812,226 | * | 11/1957 | Wolters | 312/310 X |
| 3,431,040 | * | 3/1969 | Phelps et al. | 312/272 |
| 3,726,580 | | 4/1973 | Guth . | |
| 3,809,450 | | 5/1974 | Guth . | |
| 4,097,099 | | 6/1978 | Spiegel . | |
| 5,115,822 | * | 5/1992 | Nichols | 312/312 X |
| 5,474,378 | | 12/1995 | Smith et al. . | |
| 5,595,200 | * | 1/1997 | Favaro | 312/310 X |
| 5,657,878 | | 8/1997 | Austin . | |
| 5,971,513 | * | 10/1999 | Cassalia | 312/310 |

* cited by examiner

*Primary Examiner*—Peter M. Cuomo
*Assistant Examiner*—James O. Hansen

(57) ABSTRACT

A lower rack lifting device for a dishwasher for loading and unloading the lower rack without having to stoop. The lower rack lifting device for a dishwasher includes a plurality of track members including first track members being adapted to be securely mounted upon and spaced to either side of a bottom wall of a dishwasher and also including second track members being adapted to be securely mounted to side walls of the dishwasher near an opening to the dishwasher; and also includes a scissors-like lifting assembly for lifting the lower rack upwardly upon the lower rack being moved out from the dishwasher; and further includes a plurality of roller members including first roller members being mounted upon the third track members, and also including second roller members being mounted to the scissors-like lifting assembly, and further including third roller members being adapted to be securely mounted to the lower rack and being movably disposed in the second track members.

8 Claims, 3 Drawing Sheets

LOWER RACK LIFTING DEVICE FOR A DISHWASHER

BACKGROUND OF THE INVENTION

1. Field of the Invention

The present invention relates to a dishwasher lower rack lifting means and more particularly pertains to a new lower rack lifting device for a dishwasher for loading and unloading the lower rack without having to stoop.

2. Description of the Prior Art

The use of a dishwasher lower rack lifting means is known in the prior art. More specifically, a dishwasher lower rack lifting means heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,097,099; U.S. Pat. No. 5,657,878; U.S. Pat. No. 3,809,450; U.S. Pat. No. 5,474,378; U.S. Pat. No. 3,726,580; and U.S. Pat. No. Des. 247,416.

While these devices fulfill their respective, particular objectives and requirements, the aforementioned patents do not disclose a new lower rack lifting device for a dishwasher. The inventive device includes a plurality of track members including first track members being adapted to be securely mounted upon and spaced to either side of a bottom wall of a dishwasher and also including second track members being adapted to be securely mounted to side walls of the dishwasher near an opening to the dishwasher; and also includes a scissors-like lifting assembly for lifting the lower rack upwardly upon the lower rack being moved out from the dishwasher; and further includes a plurality of roller members including first roller members being mounted upon the third track members, and also including second roller members being mounted to the scissors-like lifting assembly, and further including third roller members being adapted to be securely mounted to the lower rack and being movably disposed in the second track members.

In these respects, the lower rack lifting device for a dishwasher according to the present invention substantially departs from the conventional concepts and designs of the prior art, and in so doing provides an apparatus primarily developed for the purpose of loading and unloading the lower rack without having to stoop.

SUMMARY OF THE INVENTION

In view of the foregoing disadvantages inherent in the known types of dishwasher lower rack lifting means now present in the prior art, the present invention provides a new lower rack lifting device for a dishwasher construction wherein the same can be utilized for loading and unloading the lower rack without having to stoop.

The general purpose of the present invention, which will be described subsequently in greater detail, is to provide a new lower rack lifting device for a dishwasher which has many of the advantages of the dishwasher lower rack lifting means mentioned heretofore and many novel features that result in a new lower rack lifting device for a dishwasher which is not anticipated, rendered obvious, suggested, or even implied by any of the prior art dishwasher lower rack lifting means, either alone or in any combination thereof.

To attain this, the present invention generally comprises a plurality of track members including first track members being adapted to be securely mounted upon and spaced to either side of a bottom wall of a dishwasher and also including second track members being adapted to be securely mounted to side walls of the dishwasher near an opening to the dishwasher; and also includes a scissors-like lifting assembly for lifting the lower rack upwardly upon the lower rack being moved out from the dishwasher; and further includes a plurality of roller members including first roller members being mounted upon the third track members, and also including second roller members being mounted to the scissors-like lifting assembly, and further including third roller members being adapted to be securely mounted to the lower rack and being movably disposed in the second track members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lower rack lifting device for a dishwasher which has many of the advantages of the dishwasher lower rack lifting means mentioned heretofore and many novel features that result in a new lower rack lifting device for a dishwasher which is not anticipated, rendered obvious, suggested, or even implied by any of the prior art dishwasher lower rack lifting means, either alone or in any combination thereof.

It is another object of the present invention to provide a new lower rack lifting device for a dishwasher which may be easily and efficiently manufactured and marketed.

It is a further object of the present invention to provide a new lower rack lifting device for a dishwasher which is of a durable and reliable construction.

An even further object of the present invention is to provide a new lower rack lifting device for a dishwasher which is susceptible of a low cost of manufacture with regard to both materials and labor, and which accordingly is then susceptible of low prices of sale to the consuming public, thereby making such lower rack lifting device for a dishwasher economically available to the buying public.

Still yet another object of the present invention is to provide a new lower rack lifting device for a dishwasher which provides in the apparatuses and methods of the prior art some of the advantages thereof, while simultaneously overcoming some of the disadvantages normally associated therewith.

Still another object of the present invention is to provide a new lower rack lifting device for a dishwasher for loading and unloading the lower rack without having to stoop.

Yet another object of the present invention is to provide a new lower rack lifting device for a dishwasher which includes a plurality of track members including first track members being adapted to be securely mounted upon and spaced to either side of a bottom wall of a dishwasher and also including second track members being adapted to be securely mounted to side walls of the dishwasher near an opening to the dishwasher; and also includes a scissors-like lifting assembly for lifting the lower rack upwardly upon the lower rack being moved out from the dishwasher; and further includes a plurality of roller members including first roller members being mounted upon the third track members, and also including second roller members being mounted to the scissors-like lifting assembly, and further including third roller members being adapted to be securely mounted to the lower rack and being movably disposed in the second track members.

Still yet another object of the present invention is to provide a new lower rack lifting device for a dishwasher that allows the user to load and unload the lower rack without having to bend over in order to do so.

Even still another object of the present invention is to provide a new lower rack lifting device for a dishwasher that can be conveniently lowered and raised as desired by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
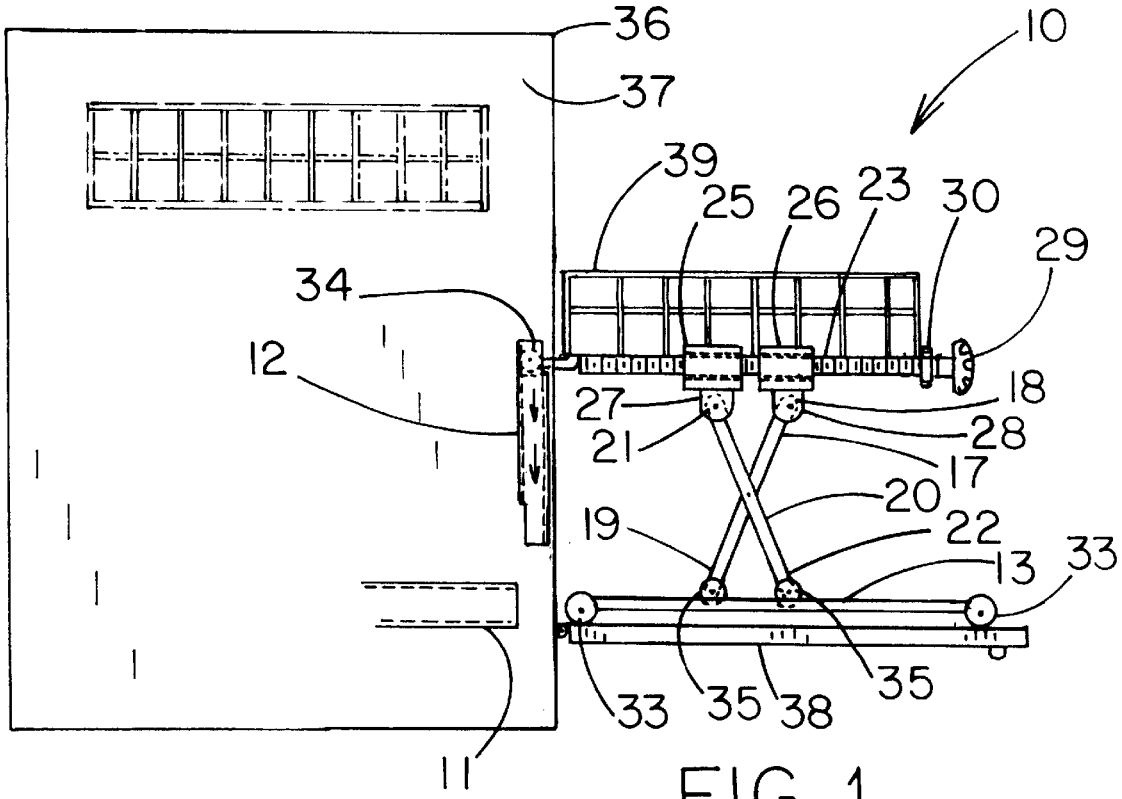
FIG. 1 is a side elevational view of a new lower rack lifting device for a dishwasher according to the present invention with the lower rack being raised.
Figure 3:
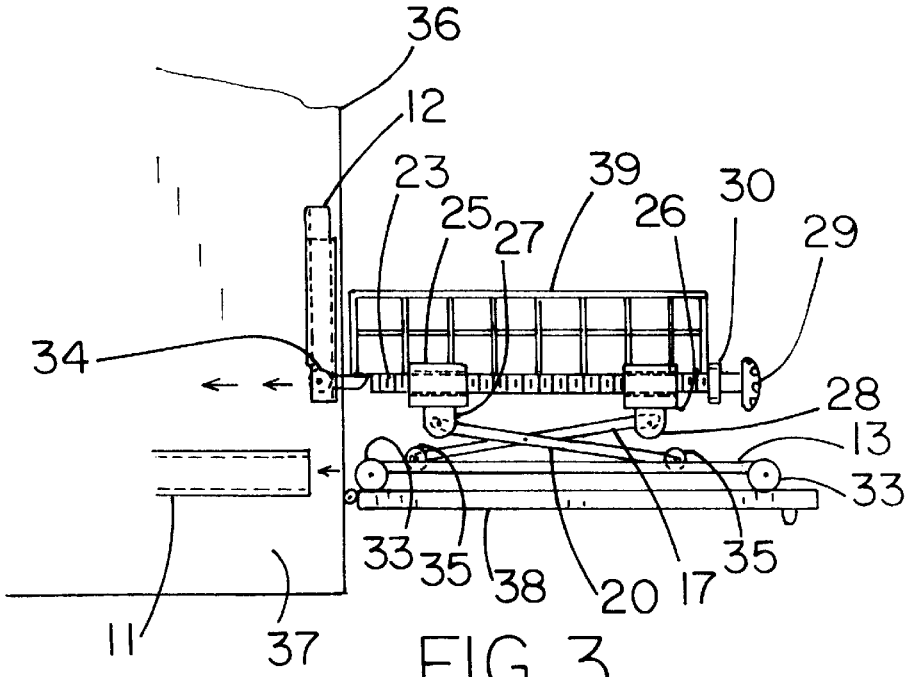
FIG. 3 is another side elevational view of the present invention with the lower rack being lowered.
Figure 2:
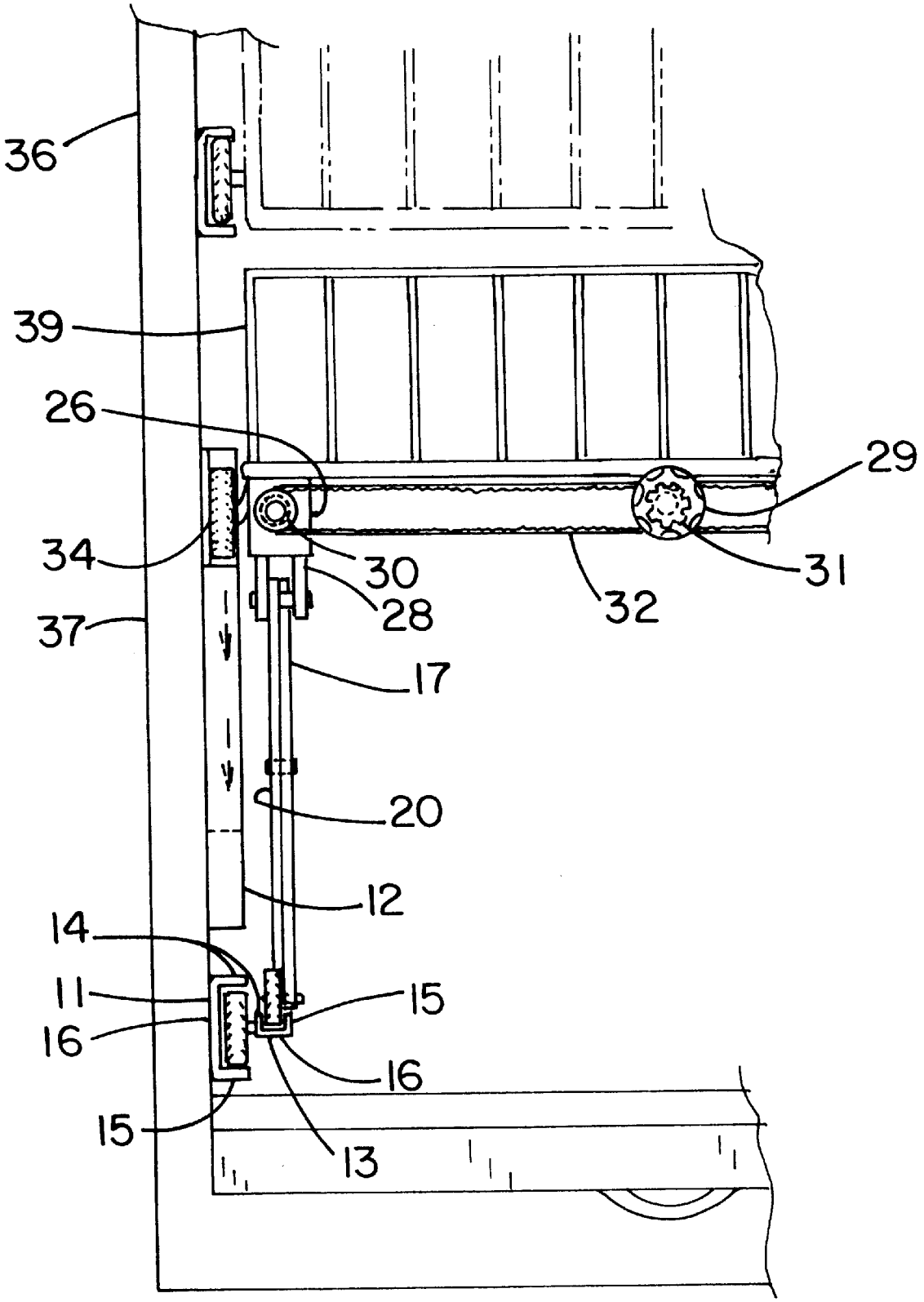
FIG. 2 is a partial end elevational view of one of the roller members and track members of the present invention.
Figure 4:
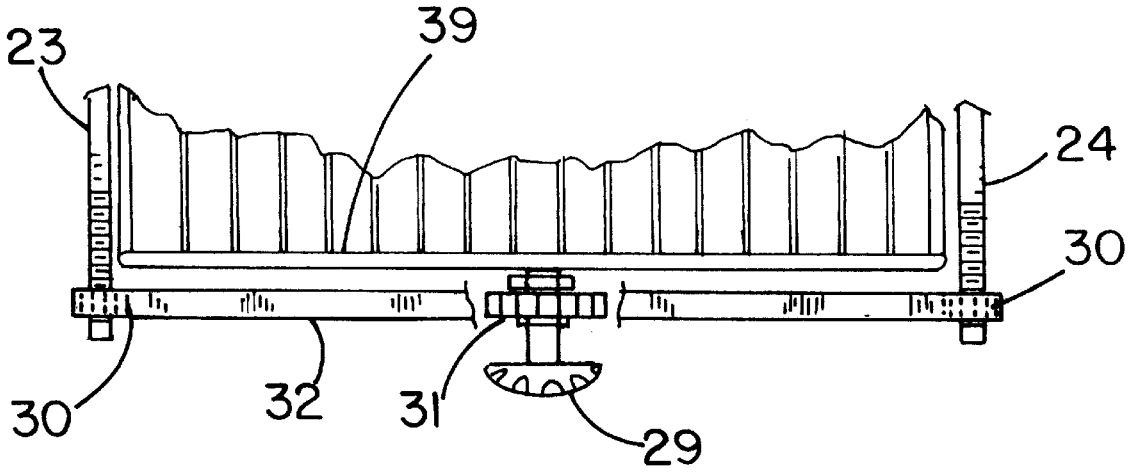
FIG. 4 is a top plan view of the crank member and the endless chain and the elongate sleeve support members of the present invention.
Figure 5:
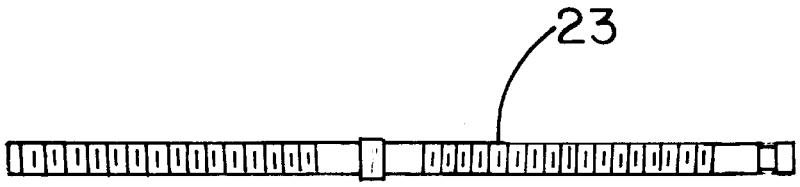
FIG. 5 is a side elevational view of one of the elongate sleeve support members of the present invention.

With reference now to the drawings, and in particular to FIGS. 1 through 5 thereof, a new lower rack lifting device for a dishwasher embodying the principles and concepts of the present invention and generally designated by the reference numeral 10 will be described.

As best illustrated in FIGS. 1 through 5, the lower rack lifting device for a dishwasher 10 generally comprises a plurality of track members 11–13 including first track members 11 being adapted to be securely mounted upon and spaced to either side of a bottom wall of a dishwasher 36 and also including second track members 12 being adapted to be securely mounted to side walls 37 of the dishwasher 36 near an opening to the dishwasher 36.

A scissors-like lifting assembly for lifting the lower rack 39 upwardly upon the lower rack 39 being moved out from the dishwasher 36 includes elongate brace members 17,20 each having first and second ends 18,19,21,22 and the elongate brace members 17,20 being pivotally and conventionally attached to one another at intermediate portions thereof, and also including threaded elongate sleeve support members 23,24 being adapted to be rotatably and conventionally mounted to and extending along a length of the lower rack 39, and further including bracket support sleeves 25,26 being threaded upon the elongate sleeve support members 23,24 and also including bracket members 27,28 being securely and conventionally attached to the bracket support sleeves 25,26 with the first ends 18,21 of the elongate brace members 17,20 being securely attached to the bracket members 27,28, and further including a crank member 29 adapted to being rotatably attached to the lower rack 39 for raising and lowering the lower rack 39, and also including gear members 30,31 being securely and conventionally mounted to the threaded elongate sleeve support members 23,24 and to the crank member 29, and further including an endless belt 32 carried by the gear members 30,31. Each of the threaded elongate sleeve support members 23,24 includes two of the bracket support sleeves 25,26 which are movable either toward one another to raise the lower rack 39 or away from one another to lower the lower rack 39 with the crank member 29 being adapted to rotate the elongate threaded sleeve support members 23,24 either clockwise or counterclockwise to move the bracket support sleeves 25,26 either toward or away from one another.

A plurality of roller members 33–35 includes first roller members 33 being mounted upon the first track members 11, and also includes second roller members 35 being mounted to the scissors-like lifting assembly, and further includes third roller members 34 being adapted to be securely mounted to the lower rack 39 and being movably disposed in the second track members 12. Each of the track members 11–13 includes a channel having a main portion 16 and longitudinal end portions 14,15 extended outwardly from the main portion 16 for securely retaining the roller members 33–35 within the channel. The track members include third track members 13 being securely and conventionally mounted to the first roller members 33. The second roller members 35 are movably disposed upon the third track members with the second track members 12 being vertically disposed to allow the third roller members 34 to move upwardly and downwardly when the lower rack 39 is being raised and lowered.

In use, the user will open the door 38 of the dishwasher 36 and will move the lower rack 39 outwardly of the dishwasher 36 and will raise the lower rack 39 by turning the crank member 29 which will move the bracket support sleeves 25,26 toward one another on a respective elongate sleeve support member 23,24. Once finished either loading or unloading the lower rack 39, the user will lower the lower rack 39 by turning the crank member 29 the opposite direction. Once the lower rack 39 is lowered, the user then moves the lower rack 39 into the dishwasher 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lower rack lifting device for a dishwasher comprising:

a plurality of track members including first track members being adapted to be securely mounted upon and spaced to either side of a bottom portion of a dishwasher and also including second track members being adapted to be securely mounted to side walls of the dishwasher near an opening to the dishwasher;

a lifting assembly for lifting a lower rack of the dishwasher upwardly upon the lower rack being moved out from the dishwasher;

a plurality of roller members including first roller members being mounted upon said first track members, and also including second roller members being mounted to said lifting assembly, and further including third roller members being adapted to be securely mounted to the lower rack and being movably disposed in said second track members;

wherein each of said track members includes a channel having a main portion and longitudinal end portions extended outwardly from said main portion for securely retaining said first and third roller members within the respective channels of said first and second track members.

2. A lower rack lifting device for a dishwasher as described in claim 1, wherein said track members include third track members being securely mounted to said first roller members.

3. A lower rack lifting device for a dishwasher as described in claim 2, wherein said second roller members are movably disposed upon said third track members.

4. A lower rack lifting device for a dishwasher as described in claim 1, wherein said lifting assembly includes elongate brace members each having first and second ends and said elongate brace members being pivotally attached to one another at intermediate portions thereof, and also includes threaded elongate sleeve support members being adapted to be rotatably mounted to and extending along a length of the lower rack, and further includes bracket support sleeves being threaded upon said elongate sleeve support members, and further includes bracket members being securely attached to said bracket support sleeves with said first ends of said elongate brace members being securely attached to said bracket members, and also includes a crank member adapted to being rotatably attached to the lower rack for raising and lowering the lower rack, and further including gear members being securely mounted to said threaded elongate sleeve support members and to said crank member, and also including an endless belt carried by said gear members.

5. A lower rack lifting device for a dishwasher as described in claim 4, wherein each of said threaded elongate sleeve support members includes two of said bracket support sleeves which are movably either toward one another to raise the lower rack or away from one another to lower the lower rack.

6. A lower rack lifting device for a dishwasher as described in claim 4, wherein said crank member is adapted to rotate said elongate threaded sleeve support members either clockwise or counterclockwise to move said bracket support sleeves either toward or away from one another.

7. A lower rack lifting device for a dishwasher as described in claim 1, wherein said second track members are vertically disposed to allow said third roller members to move upwardly and downwardly when the rack is being raised and lowered.

8. A lower rack lifting device for a dishwasher comprising:

a plurality of track members including first track members being adapted to be securely mounted upon and spaced to either side of a bottom portion of a dishwasher and also including second track members being adapted to be securely mounted to side walls of the dishwasher near an opening to the dishwasher;

a lifting assembly for lifting a lower rack of the dishwasher upwardly upon the lower rack being moved out from the dishwasher, said lifting assembly including elongate brace members each having first and second ends and said elongate brace members being pivotally attached to one another at intermediate portions thereof, and also including threaded elongate sleeve support members being adapted to be rotatably mounted to and extending along a length of the lower rack, and further including bracket support sleeves being threaded upon said elongate sleeve support members, and also including bracket members being securely attached to said bracket support sleeves with said first ends of said elongate brace members being securely attached to said bracket members, and further including a crank member adapted to being rotatably attached to the lower rack for raising and lowering the lower rack, and also including gear members being securely mounted to said threaded elongate sleeve support members and to said crank member, and further including an endless belt carried by said gear members, each of said threaded elongate sleeve support members including two of said bracket support sleeves which are movably either toward one another to raise the lower rack or away from one another to lower the lower rack, said crank member being adapted to rotate said elongate threaded sleeve support members either clockwise or counterclockwise to move said bracket support sleeves either toward or away from one another;

a plurality of roller members including first roller members being mounted upon said first track members, and also including second roller members being mounted to said lifting assembly, and further including third roller members being adapted to be securely mounted to the lower rack and being movably disposed in said second track members, each of said track members including a channel having a main portion and longitudinal end portions extended outwardly from said main portion for securely retaining said roller members within said channel, said track members including third track members being securely mounted to said first roller members, said second roller members being movably disposed upon said third track members, said second track members being vertically disposed to allow said third roller members to move upwardly and downwardly when the rack is being raised and lowered.

* * * * *